US010047650B2

(12) United States Patent
Abram

(10) Patent No.: US 10,047,650 B2
(45) Date of Patent: Aug. 14, 2018

(54) VEHICLE EXHAUST SYSTEM WITH RESISTIVE PATCH

(71) Applicant: Faurecia Emissions Control Technologies, USA, LLC, Columbus, IN (US)

(72) Inventor: Kwin Abram, Columbus, IN (US)

(73) Assignee: Faurencia Emissions Technologies USA, LLC, Columbus, IN (US)

( * ) Notice: Subject to any disclaimer, the term of this patent is extended or adjusted under 35 U.S.C. 154(b) by 7 days.

(21) Appl. No.: 15/127,486

(22) PCT Filed: Mar. 31, 2014

(86) PCT No.: PCT/US2014/032302

§ 371 (c)(1),
(2) Date: Sep. 20, 2016

(87) PCT Pub. No.: WO2015/152858

PCT Pub. Date: Oct. 8, 2015

(65) Prior Publication Data

US 2017/0145881 A1 May 25, 2017

(51) Int. Cl.
*F01N 1/02* (2006.01)
*F01N 1/08* (2006.01)
(Continued)

(52) U.S. Cl.
CPC ..... *F01N 1/02* (2013.01); *F01N 1/08* (2013.01); *F01N 13/08* (2013.01); *G10K 11/161* (2013.01); *F01N 2390/00* (2013.01)

(58) Field of Classification Search
CPC ... F01N 1/023; F01N 1/02; F01N 1/04; F01N 1/08; F01N 1/026; F01N 1/082; F01N 1/163; F02M 35/1222
(Continued)

(56) References Cited

U.S. PATENT DOCUMENTS 2,297,046 A * 9/1942 Bourne ..... F01N 1/006 110/184
3,147,097 A 9/1964 Aguas
(Continued)

FOREIGN PATENT DOCUMENTS

DE 102009005469 A1 7/2010
EP 1803907 A2 7/2007
(Continued)

OTHER PUBLICATIONS

International Search Report from corresponding PCT application.
Supplementary European Search Report for European Application No. 14887790.5 dated Nov. 22, 2017.

*Primary Examiner* — Jeremy Luks

(74) *Attorney, Agent, or Firm* — Carlson, Gaskey & Olds, P.C.

(57) ABSTRACT

A vehicle exhaust system includes an exhaust component having an outer surface and an inner surface that defines an internal exhaust component cavity. At least one hole is formed in the exhaust component to extend through a wall of the exhaust component from the outer surface to the inner surface. A member is formed from a resistive material and is configured to overlap the at least one hole. At least one spacer is configured to space the member away from the inner or outer surface of the exhaust component to create an open cavity between the member and the exhaust component. In one example, an actuator is configured to cover and uncover the member dependent upon an operating characteristic to vary damping.

28 Claims, 9 Drawing Sheets

(51) Int. Cl.
*F01N 13/08* (2010.01)
*G10K 11/16* (2006.01)

(58) Field of Classification Search
USPC ..... 181/229, 237, 254
See application file for complete search history.

(56) References Cited

U.S. PATENT DOCUMENTS 5,493,080 A * 2/1996 Moss ..... F01N 1/003 181/227
5,962,821 A 10/1999 Iannetti
6,517,595 B2 * 2/2003 Kino ..... F02M 35/10118 123/198 E
6,959,678 B2 * 11/2005 Kino ..... B29C 65/568 123/184.53
7,111,601 B2 * 9/2006 Moenssen ..... F02M 35/10137 123/184.53
7,530,428 B2 5/2009 Feist et al.
8,132,552 B2 * 3/2012 Matsumoto ..... F02M 35/1238 123/184.61
8,485,153 B2 * 7/2013 Satarino ..... F02M 35/10144 123/184.21
8,528,692 B2 * 9/2013 Teshima ..... F02M 35/10144 123/184.53
2003/0062013 A1 * 4/2003 Kino ..... B29C 65/2015 123/184.53
2007/0045043 A1 * 3/2007 Hoerr ..... F01N 1/003 181/250
2008/0035421 A1 * 2/2008 Feist ..... F01N 1/003 181/212
2008/0041657 A1 * 2/2008 Ido ..... F01N 1/023 181/255

FOREIGN PATENT DOCUMENTS

EP 2017440 2/2010
GB 2056563 A 3/1981
JP 60125764 7/1985
JP 64034460 3/1989
JP 04259616 9/1992
KR 1020000053584 8/2000

* cited by examiner

VEHICLE EXHAUST SYSTEM WITH RESISTIVE PATCH

TECHNICAL FIELD

The subject invention relates to a vehicle exhaust system component that includes a resonance damper to dampen noise. The subject invention further concerns a resonance damper that is passively or actively controlled to vary damping as needed.

BACKGROUND OF THE INVENTION

Vehicle exhaust systems direct exhaust gases generated by an internal combustion engine to the external environment. These systems are comprised of various components such as pipes, converters, catalysts, filters, etc. The overall system and/or the components are capable of generating undesirable noise as a result of resonating frequencies. Different approaches have been used to address this issue.

For example, components such as mufflers, resonators, valves, etc., have been incorporated into exhaust systems in an attempt to attenuate certain resonance frequencies generated by the exhaust system. The disadvantage of adding additional components is that it is expensive and increases weight. Further, adding components introduces new sources for noise generation.

Another approach utilizes a series of holes formed within a pipe that are covered with a microperforated material to dampen noise. In order to achieve the desired noise attenuation, the holes have to be relatively large in size. One disadvantage with this configuration is that the microperforated material is very thin and is not as structurally sound as the solid pipe wall. If large holes are cut into the pipe and covered with the microperforated material, the durability of the pipe may be adversely affected. Another concern is with grazing flow that occurs across the surface of the microperforated material. The acoustic properties of perforated material will change when exhaust gas flows across the surface of the material. This can often reduce the ability of the acoustic wave to propagate through the perforations, which limits the damping effect.

SUMMARY OF THE INVENTION

According to one exemplary embodiment, a vehicle exhaust system includes an exhaust component having an outer surface and an inner surface that defines an internal exhaust component cavity. At least one hole is formed in the exhaust component to extend through a wall of the exhaust component from the outer surface to the inner surface. A member is formed from a resistive material and is configured to overlap the at least one hole. At least one spacer is configured to space the member away from the inner or outer surface of the exhaust component to create an open cavity between the member and the exhaust component.

In another embodiment according to the previous embodiment, the at least one hole comprises only one hole with a remainder of the exhaust component having a solid wall without any other hole formations.

In another embodiment according to any of the previous embodiments, the resistive material is a microperforated sheet of material.

In another embodiment according to any of the previous embodiments, the resistive material comprises a powdered metal.

In another embodiment according to any of the previous embodiments, the hole defines an opening having a first overall area, and the open cavity defines a second overall area that is greater than the first overall area.

In another embodiment according to any of the previous embodiments, the member defines a third overall area that is greater than the second overall area.

In another embodiment according to any of the previous embodiments, the exhaust component comprises a pipe.

In another embodiment according to any of the previous embodiments, an outer retainer secures the member against the spacer.

In another embodiment according to any of the previous embodiments, the outer retainer, the member, and the spacer are welded to the exhaust component.

In another embodiment according to any of the previous embodiments, an actuator is configured to cover and uncover the member dependent upon an operating characteristic.

In another exemplary embodiment, a vehicle exhaust system includes an exhaust component having an outer surface and an inner surface that defines an internal exhaust component cavity. At least one hole is formed in the exhaust component to extend through a wall of the exhaust component from the outer surface to the inner surface. A resonance damper is associated with the at least one hole, and an actuator configured to cover and uncover the resonance damper to vary damping dependent upon an operating characteristic.

In another embodiment according to any of the previous embodiments, the actuator is passively controlled to vary damping.

In another embodiment according to any of the previous embodiments, the actuator is actively controlled to vary damping.

In another embodiment according to any of the previous embodiments, the operating characteristic comprises at least one or more of a back pressure characteristic, a mass flow characteristic, a temperature characteristic, an engine speed characteristic, an acoustic pressure characteristic, and a user driving condition.

These and other features may be best understood from the following drawings and specification.

DETAILED DESCRIPTION

Figure 1:
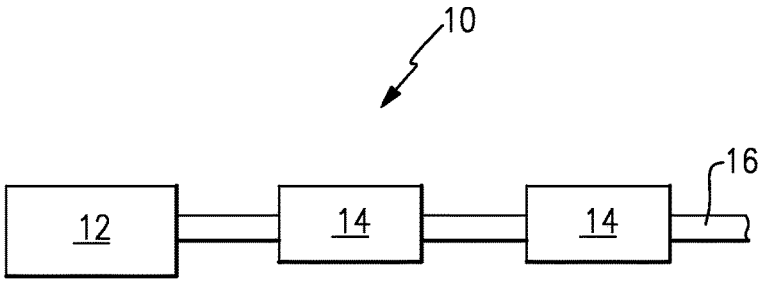
FIG. 1 schematically illustrates one example of an exhaust system.

FIG. 1 shows a vehicle exhaust system 10 that conducts hot exhaust gases generated by an internal combustion engine 12 through various downstream exhaust components 14 to reduce emissions and control noise as known. The exhaust components 14 can include diesel oxidation catalysts (DOC), selective catalytic reduction (SCR) catalysts, particulate filters, exhaust pipes, etc. These components 14 can be mounted in various different configurations and combinations dependent upon vehicle application and available packaging space. Exhaust gases pass through the components 14 and is subsequently directed to the external atmosphere via a tailpipe 16, for example.

The exhaust system 10 includes at least one acoustic damping member 18 (shown schematically in FIG. 2) that dampens resonance frequencies generated during operation of the system 10. In one example, the acoustic damping member 18 is used in an exhaust pipe 20 having an outer surface 22 and an inner surface 24 that defines an internal exhaust component cavity 26. The inner surface 24 defines an exhaust gas flow path F.

At least one hole 28 is formed in the pipe 20 to extend through a wall 30 of the pipe 20 from the outer surface 22 to the inner surface 24. The member 18 is formed from a resistive material and is configured to overlap the hole 28. It should be understood that while the member 18 is shown as being used with a pipe 20, the member 18 could also be used in any of the various exhaust components 14 as needed, such as in a muffler or in a pipe that is mounted within a muffler, for example.

Figure 3:
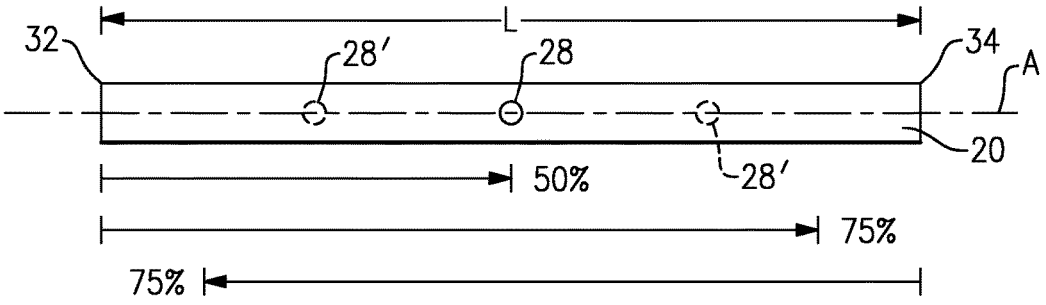
FIG. 3 schematically illustrates possible mounting locations of the acoustic damping member along the pipe.

FIG. 3 shows the pipe 20 extending along a central axis A from a first pipe end 32 to a second pipe end 34. In one example, the at least one hole comprises the only hole 28 in the pipe 20 that extends entirely through the wall 30. The pipe 20 is defined by an overall pipe length L from the first pipe end 32 to the second pipe end 34. In one example, the single hole 28 is positioned at a location that is approximately 50% of the pipe length, i.e. the hole 28 is positioned generally at an equal distance from each of the first pipe end 32 and the second pipe end 34. This hole location is very effective because it is located near an acoustic standing wave pressure anti-node (maximum pressure point). For example, in a first mode comprising a ½ wave mode, the hole 28 is located as shown in FIG. 3 where it is at a position that is approximately 50% of the overall length L from either the first 32 or second 34 pipe end. This is discussed in greater detail in applicant's co-pending application no. PCT/US2013/25693 filed on Feb. 12, 2013, and which is herein incorporated by reference.

In another example, the at least one hole comprises only a first hole 28 and a second hole 28' that extend entirely through the wall 30. In this example, the first hole 28 is positioned at the location that is approximately 50% of the pipe length L and the second hole 28' is positioned at location that is approximately 75% of the pipe length as optionally indicated at one of two possible locations in FIG. 3. This position generally corresponds to a ¼ wave mode. The benefits of this location are described in detail in the co-pending application referenced above. Each hole 28, 28' would be covered by one member 18 formed of the resistive material.

Figure 2:
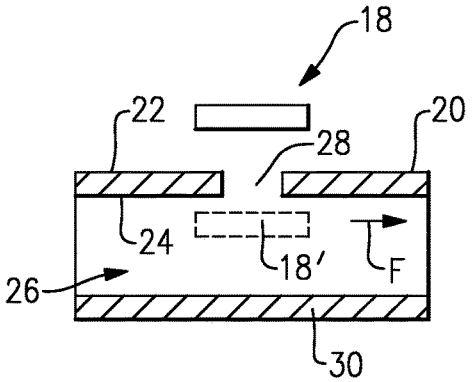
FIG. 2 schematically illustrates one example of a pipe with an acoustic damping member as used in the exhaust system of FIG. 1.
Figure 4:
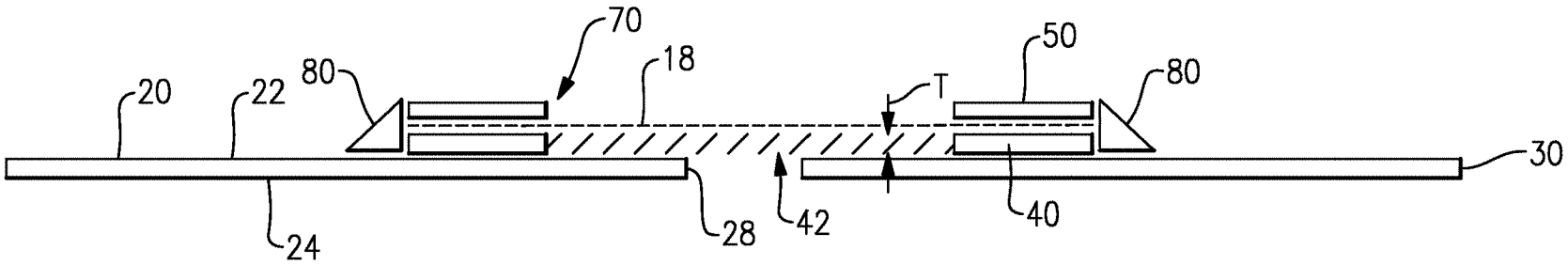
FIG. 4 schematically illustrates the acoustic damping member mounted to an external surface of the pipe.

FIG. 4 shows a schematic representation of the acoustic damping member 18. It should be understood that the member could be configured to cover the hole 28 at the external surface 22 or the internal surface 24 of the pipe 20. When mounted to the internal surface 24 as indicated in FIG. 2, the member 18' is protected from damage from rocks and other debris. When mounted to the external surface 22, as shown in FIG. 4, the member 18 is separated from high velocity gas flow which further improves acoustic performance.

The acoustic damping member 18 is comprised of a resistive material such as a sheet or mat of microperforated material, for example. This type of material has a high density of very small openings extending through the sheet. In one example, the microperforated material has approximately 5% porosity. Optionally, other resistive materials could also be used, such as a powdered metal material for example. Further, the microperforated or resistive material provides a specified amount of resistivity, i.e. material resistance ($Ns/m^3$). In one example, material resistance is at least 25 $Ns/m^3$. A preferred range is 50-3000 $Ns/m^3$.

Figure 5:
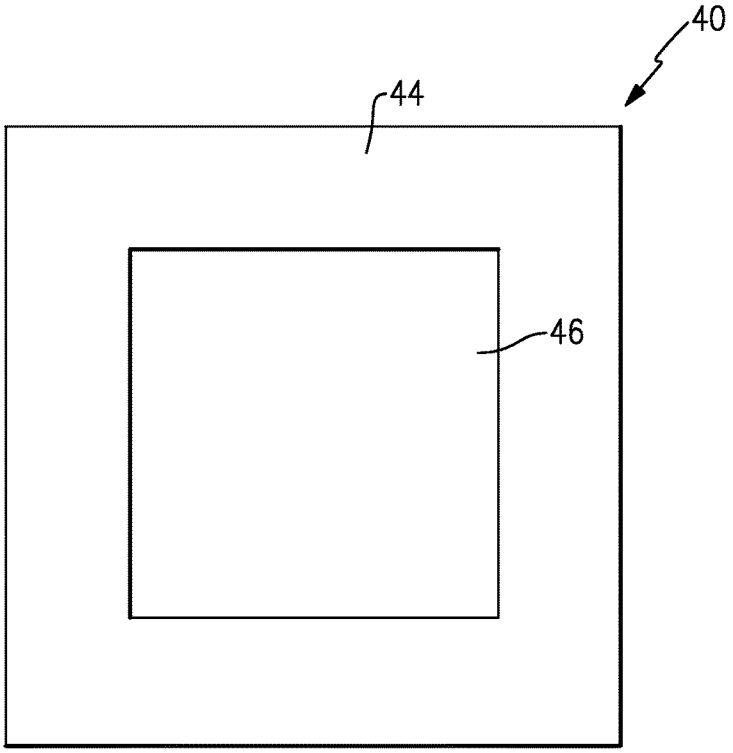
FIG. 5 is a top view of a spacer as used with the acoustic damping member.

At least one spacer 40 is configured to space the member 18 away from the inner 24 or outer 22 surface of the pipe to create an open cavity 42 between the member 18 and the pipe 20. In one example, the spacer 40 is comprised of a thin sheet of material, such as sheet metal for example. This thickness of the spacer 40 is tailored to define the thickness/height T of the cavity 42. The spacer 40 is spaced apart from both sides of the hole by a distance to define a length of the cavity 42. As shown in FIG. 5, in one example, the spacer 40 is comprised of a body 44 having an open center area 46 that corresponds to the area of the cavity 42. The body 44 can be a single-piece structure or be formed from multiple pieces attached to each other.

In one example, the hole 28 defines an opening having a first overall area, and the open cavity 42 defines a second overall area that is greater than the first overall area. In other words, the size of the opening 28 is relatively small when compared to the open area provided in the cavity 42. The cavity 42 allows the acoustic waves to more effectively communicate with the resistive material. Further, as the material overlaps the entire cavity 42, it maximizes the surface area of material that communicates with the acoustic waves.

The member 18 defines a third overall area that is greater than the second overall area. As such, the hole 28 is much smaller in size than the area of resistive material. This improves the structural integrity of the pipe 20 by using a smaller hole in combination with the enlarged cavity 42. Further, a single hole can be used at an optimal location, as opposed to having multiple holes. This can reduce cost by reducing the number of holes to be created and allows a single resistive patch to be applied to the single location.

Figure 6:
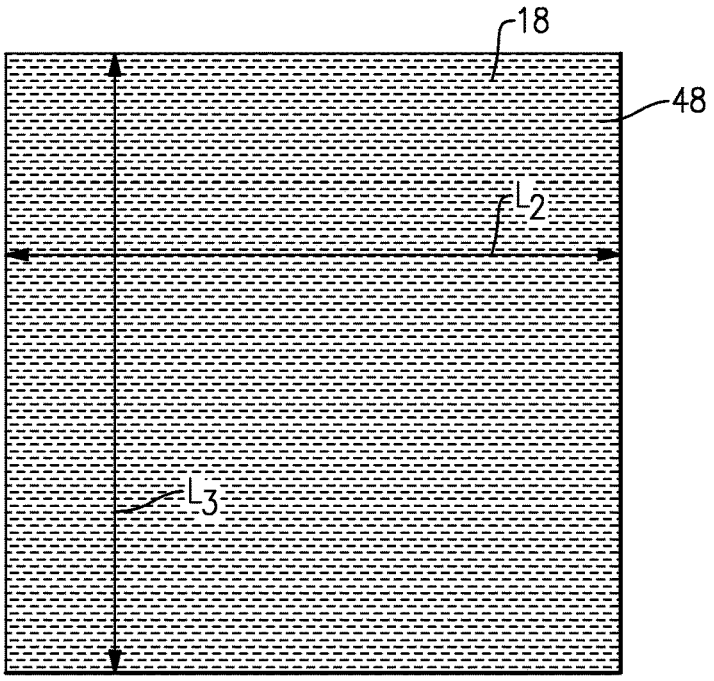
FIG. 6 is a top view of the acoustic damping member.

As shown in FIG. 6, the member 18 comprises a continuous piece of resistive material, i.e. a single piece of material, which is cut or shaped to a desired size. As discussed above, the material has a high density of very small openings 48 extending through the sheet to provide a desired porosity. By using one piece, the design is simplified and labor, material, and scrap costs are reduced.

Figure 7:
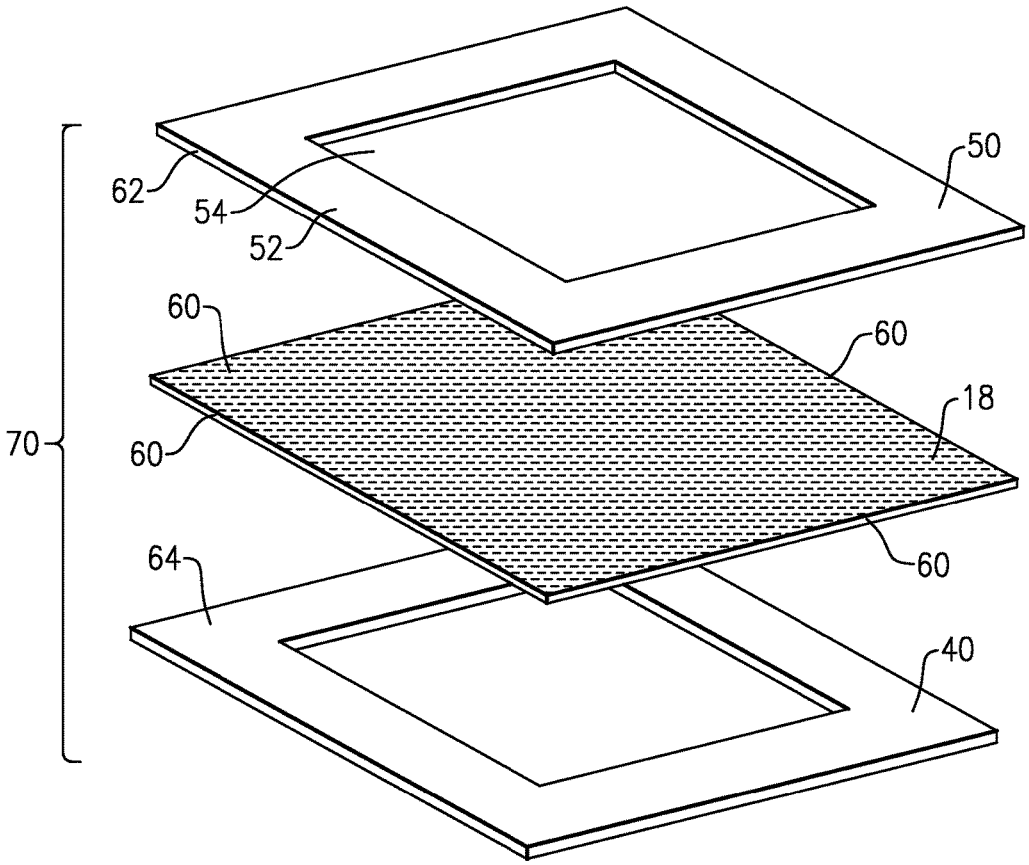
FIG. 7 is an exploded view of the spacer, acoustic damping member, and outer retainer.

In one example, to easily fix or attach the member 18 to the pipe 20, the member 18 is sandwiched between the spacer 40 and an outer retainer 50 (FIG. 7). The retainer 50 is configured similarly to the spacer 40 and is comprised of a body 52 having an open center area 54 that corresponds to the area of the cavity 42. The outer retainer 50 protects the resistive material during manufacturing and also during operational use. While a single opening, i.e. an open center is shown, it should be understood that a plurality of openings could be provided in the body 52. Outer peripheral edges 60 of the member 18 are sandwiched between a bottom surface 62 of the outer retainer 50 and an upper surface 64 of the spacer 50 to form a three layer stack assembly as indicated at 70 in FIG. 4.

Figure 8:
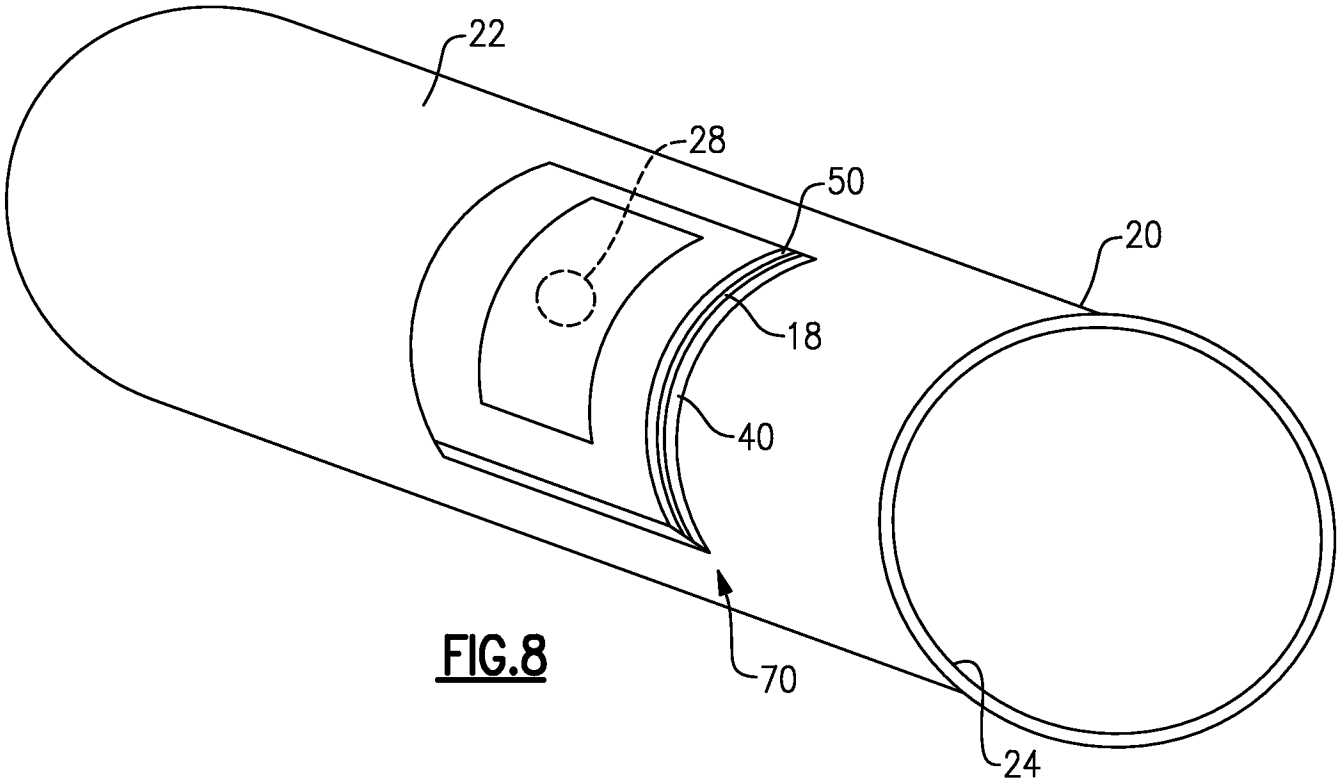
FIG. 8 is a perspective view of a pipe with the acoustic damping member, spacer, and outer retainer attached thereto.
Figure 9B:
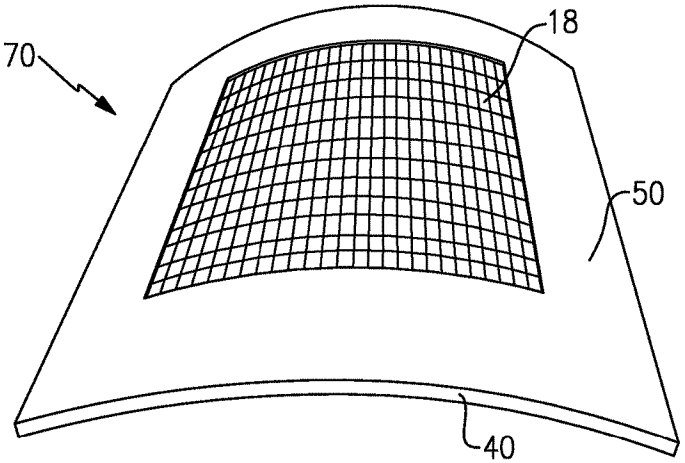
FIG. 9B is a top perspective view of the acoustic damping member, spacer, and outer retainer.
Figure 9A:
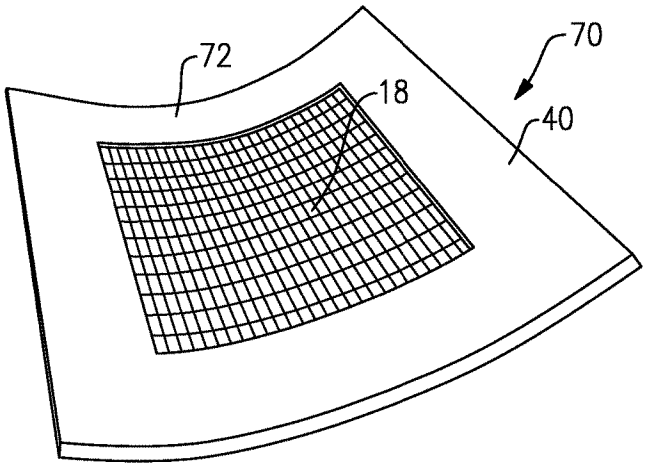
FIG. 9A is a bottom perspective view of the acoustic damping member, spacer, and outer retainer.
Figure 9C:
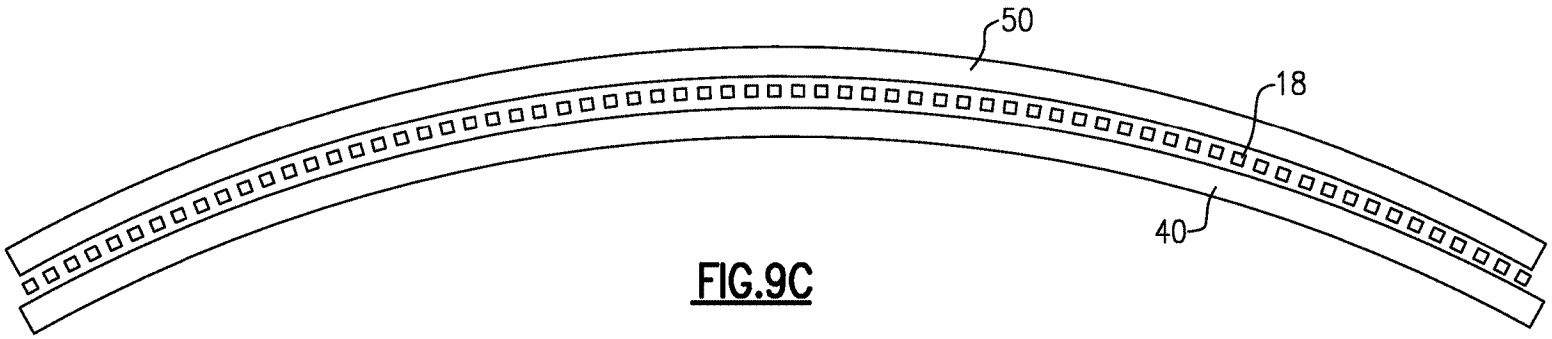
FIG. 9C is an end view of the acoustic damping member, spacer, and outer retainer.

The three layer stack 70 is then placed over the hole 28 and attached to the pipe 20 as shown in FIG. 8. As shown in FIGS. 9A-9C, the stack 70 can be formed with a slight curvature 72 to match the curvature of the pipe 20. The three layers of the stack 70 and the pipe 20 are then welded together, via a weld 80 (FIG. 4) that extends about the perimeter of the stack 70. Using a weld results in a low cost and simple attachment method. Further, the weld 80 seals all perimeter leaks to maximize the performance of the resistive material. Further, this attachment reduces the risk of having a rattling noise. Also, by welding at the edges of the three layer stack 70 the resistive material is attached without being damaged at the area that is in communication with the cavity 42.

Figure 10A:
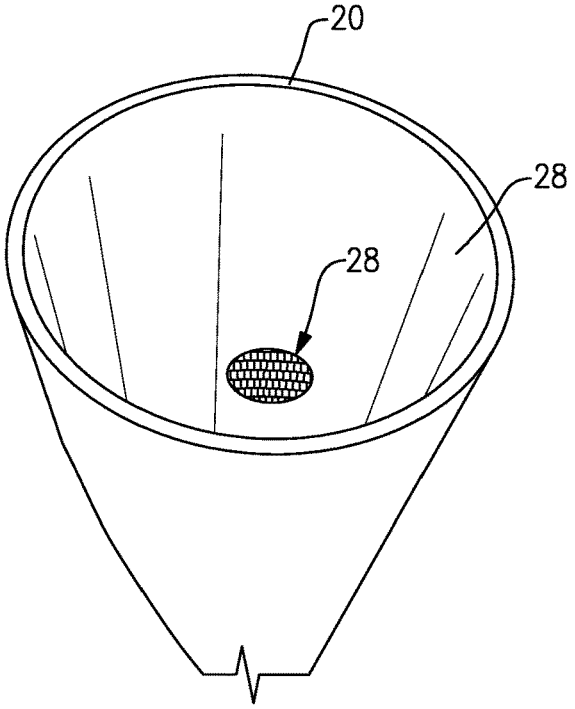
FIG. 10A is a view an externally mounted acoustic damping member as viewed from inside the pipe.
Figure 10B:
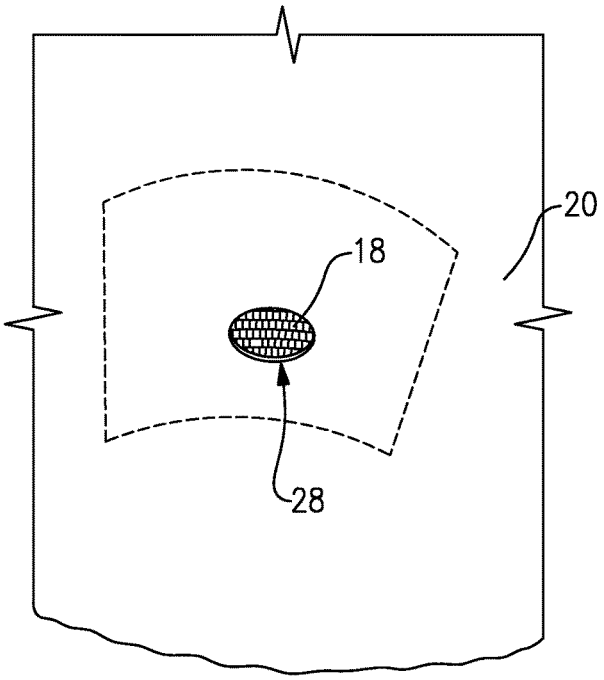
FIG. 10B is a magnified view of FIG. 10A.

When fixed to the pipe 20, the stack 70 creates the enlarged cavity 42 into which acoustic waves can communicate with the resistive material. FIG. 10A shows a view of the member 18 from inside the pipe, and FIG. 10B is a magnified view of FIG. 10A.

In one example, the size of the hole 28 and the cavity thickness T is used to determine the size and length of the member 18. The circumference of the hole 28 multiplied by the cavity thickness T should be greater than or equal to the area L2×L3 (FIG. 6) of the member 18 multiplied by the porosity of the resistive material.

When compared to prior configurations, by mounting the member 18 over a hole 28 in the pipe 20 in combination with an enlarged cavity 42, the required hole area can be reduced by as much as 95%. This significantly improves the structural integrity of the component. Further, using a smaller hole which communicates with the larger open cavity size yields very little exhaust gas movement in the cavity and thus reduces grazing flow concerns.

In order to even further enhance damping capability, the vehicle exhaust system can be configured to vary resonance damping in relation to various vehicle operating characteristics and/or user input. A resonance damper can comprise the damping member 18 as described above, or can comprise a bleed hole 88 (FIG. 11C) such as that set forth in PCT/US2013/25693 mentioned above. In this example, the bleed hole 88 comprises a discontinuous opening into the internal exhaust component cavity. The discontinuous opening into the exhaust path is provided by a porous member that is associated with the at least one bleed hole 88. In one example, the porous member comprises a sheet of microperforated material (such as that described above in relation to member 18) that is attached to the pipe 20 and covers the at least one bleed hole 88. Optionally, the porous member could comprise a boss located at the bleed hole that is formed from a powdered or sintered metal material.

Figure 11B:
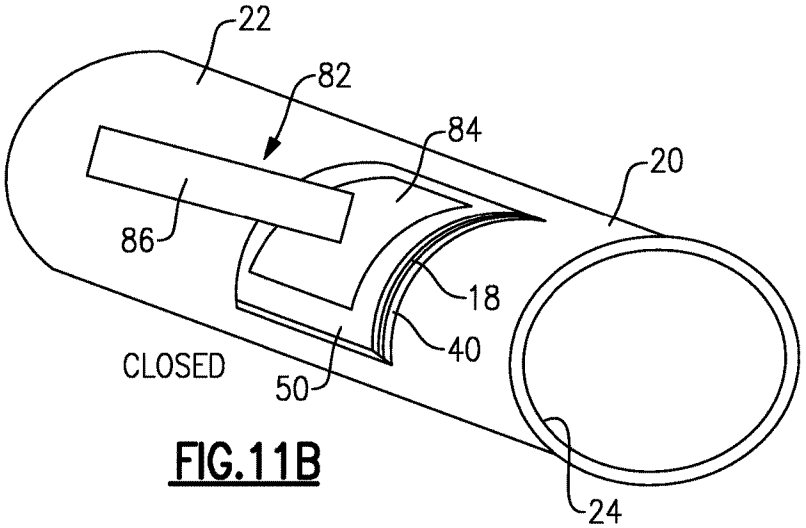
FIG. 11B is a schematic view of the actuator covering the resonance damper.
Figure 11C:
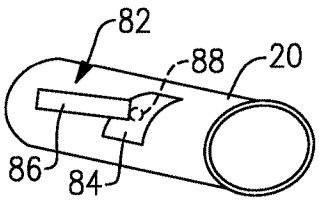
FIG. 11C is a schematic view of the actuator covering another example of a resonance damper.
Figure 11E:
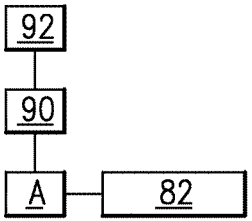
FIG. 11E is a schematic view of an actively controlled actuator.
Figure 11A:
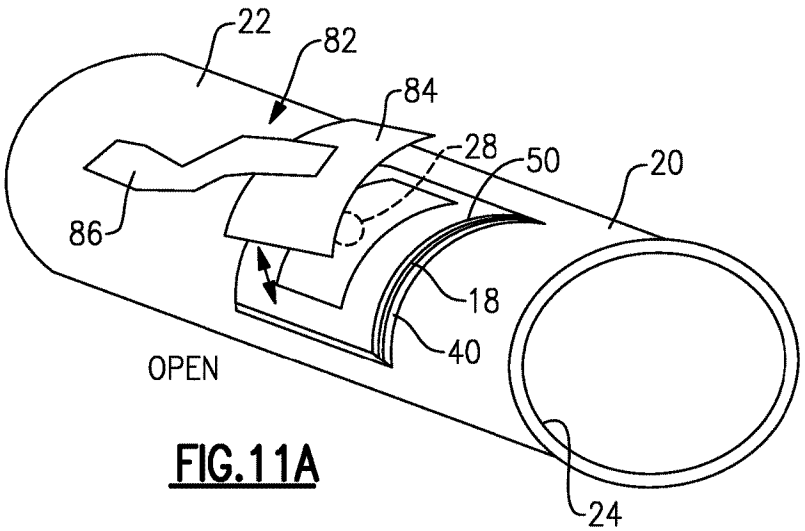
FIG. 11A is a schematic view of an actuator uncovering a resonance damper.

FIGS. 11A-11E disclose examples of a system that can be used in conjunction with a bleed hole 88 or damping member 18. FIG. 11A shows an actuator 82 as used with the resonance or acoustic damping member 18 that is shown in FIGS. 4-8. The actuator 82 includes a covering element 84 that is coupled to a movable member 86 of the actuator 82. The covering element 84 covers the member 18 under certain operating conditions (FIG. 11A) and uncovers the member 18 under certain operating conditions (FIG. 11B). The covering element 84 can also be used to cover the bleed hole 88 (FIG. 11C).

Figure 11D:
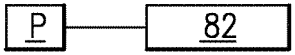
FIG. 11D is a schematic view of a passively controlled actuator.

The actuator 82 can be passively controlled (P) as shown in FIG. 11D or actively controlled (A) as shown in FIG. 11E. Examples of passive controls P include resilient resistance members such as springs for example, or a temperature actuator such as a bi-metal member, for example. Examples of active controls A include electric motors, electric solenoids, pressure or vacuum diaphragms, etc. The active control A can receive control signals from a controller 90. The controller 90 can be configured to receive sensor input from one or more sensors 92, such as exhaust temperature sensors, engine speed sensors, mass flow sensors, etc. The covering element 84 can be comprised of any heat resistant material. The covering element 84 preferably comprises a solid member that is configured to completely cover the bleed hole 88 and/or open cavity 42. The covering element 84 can be attached to the movable member 86 and/or actuator 82 using any of various attachment methods including, for example, welding, brazing, fastening, gluing, etc.

The resonance damper in the exhaust component can be covered and uncovered in response to various the operating characteristics. For example, the resonance damper could be uncovered as a function of at least one or more of the following characteristics: back pressure, mass flow rate, exhaust gas temperature, engine speed, acoustic pressure, and/or a user driving condition (sporty v. quiet). The addition of an active element to vary resonance damping in response to one or more of these characteristics optimizes and tailors damping for a variety of operating conditions.

Figure 12:
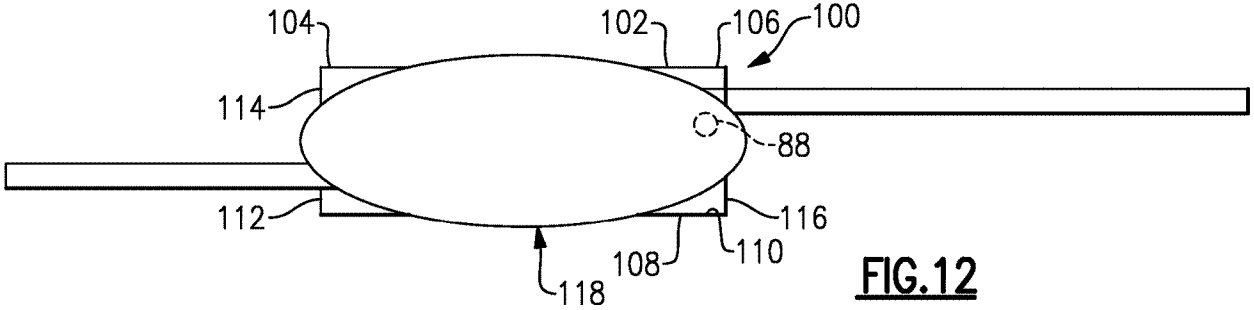
FIG. 12 is a schematic view of a resonance damper in a muffler.
Figure 13:
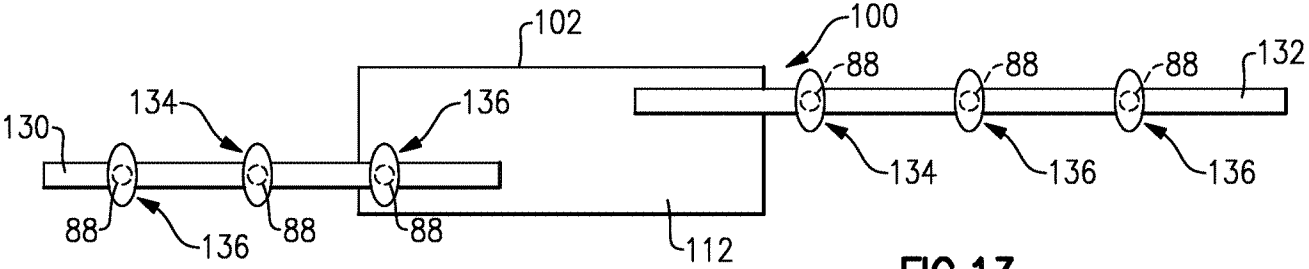
FIG. 13 is a schematic view of pipe with resonance damping at anti-node locations.
Figure 14:
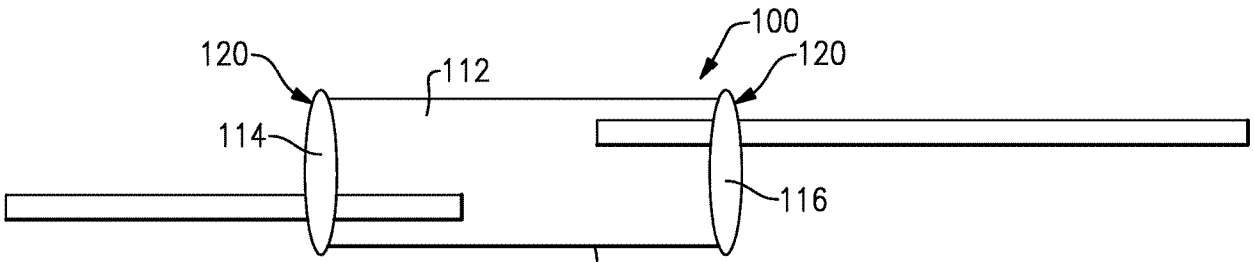
FIG. 14 schematically illustrates another example of a muffler with resonance damping.

FIGS. 12-14 show locations for bleed holes 88 for muffler resonance damping. A muffler 100 has a housing 102 extending from a first end 104 to a second end 106. The housing 102 has an outer surface 108 and an inner surface 110 that defines an internal muffler volume 112. The muffler 100 includes a first end cap 114 associated with the first end 104 and a second end cap 116 associated with the second end 106.

In these examples, the resonance damper comprises a bleed hole 88 such as that discussed above. As described above with regard to FIG. 3, resistive bleed holes 88 work well at pressure anti-nodes in pipes. For lumped parameter modes, pressure anti-nodes are located anywhere within the muffler 100 as shown in FIG. 12. For muffler standing waves, pressure anti-nodes are located in muffler end caps 114, 116.

In a lumped parameter mode the exhaust gas acts like a single lumped mass with the muffler 100 acting as a spring. This is referred to as a Helmholtz resonance. As shown in FIG. 12, in order to address the lumped parameter mode (low frequencies), one or more bleed holes 88 can be located anywhere on the muffler housing 102 or end caps 114, 116 as indicated at 118. The bleed hole 88 would be configured in a manner as described above.

In standing wave mode, e.g. ½ waves or full waves, the exhaust gas acts like a spring. As shown in FIG. 14, in order to address muffler standing waves one or more bleed holes 88 would be located on either or both of the end caps 114, 116 as indicated at 120.

As discussed above, the microperforated or porous material provides a specified amount of resistivity, i.e. material resistance ($Ns/m^3$). When used in a muffler configuration, in one example, the material resistance is at least 25 $Ns/m^3$. In another example, the material resistance is at least 160 $Ns/m^3$. A preferred range is 50-3000 $Ns/m^3$.

FIG. 13 shows an example of anti-node locations like those discussed above with regard to FIG. 3. In this example, the muffler 100 includes an inlet pipe 130 and an outlet pipe 132. One or more bleed holes 88 could be located in either or both of the pipes 130, 132 at the ½ wave mode location (indicated at 134) and/or at the ¼ wave mode location (indicated at 136). The bleed hole 88 is positioned at a location that is approximately 50% of the pipe length, i.e. the hole 88 is positioned generally at an equal distance from each of the pipe ends, when in the ½ wave mode location. The bleed hole 88 is positioned at a location that is approximately 25% or 75% of the pipe length when in the ¼ wave mode location. As discussed above, these hole locations are very effective because it is located near an acoustic standing wave pressure anti-node (maximum pressure point).

The bleed holes 88 would be configured as described above. Further, the actuator 82 could be used as needed to cover and uncover one or more of these bleed holes 88 to vary damping as needed in response to the various operational characteristics described above.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

an exhaust component having an outer surface comprising an external surface and an inner surface that defines an internal exhaust component cavity;

at least one hole directly open to external atmosphere and formed in the exhaust component to extend through a wall of the exhaust component from the external surface to the inner surface;

a member formed from a resistive material and configured to overlap the at least one hole; and at least one spacer configured to space the member away from the inner or outer surface of the exhaust component to create an open cavity between the member and the exhaust component; and further including an actuator with a covering element located externally of the exhaust component that is configured to cover and uncover the member dependent upon an operating characteristic.

2. The vehicle exhaust system according to claim 1 wherein the at least one hole comprises only one hole that is open to the external surface with a remainder of the exhaust component having a solid wall without any other hole formations.

3. The vehicle exhaust system according to claim 1 wherein the resistive material is a microperforated sheet of material having a material resistance range of 50-3000 $Ns/m^3$.

4. The vehicle exhaust system according to claim 1 wherein the resistive material comprises a powdered metal.

5. The vehicle exhaust system according to claim 1 wherein the hole defines an opening extending through the wall directly to the external atmosphere, the hole having a first overall area, and wherein the open cavity defines a second overall area that is greater than the first overall area.

6. The vehicle exhaust system according to claim 5 wherein the member defines a third overall area that is greater than the second overall area.

7. The vehicle exhaust system according to claim 1 wherein the spacer spaces the member away from the inner surface of the exhaust component in a direction inwardly toward a center of the exhaust component such that the member is positioned within the internal exhaust component cavity and facing the hole with the open cavity being formed between an inner surface of the exhaust component and an outer facing surface of the member.

8. The vehicle exhaust system according to claim 1 wherein the spacer spaces the member away from the external surface of the exhaust component in a direction outwardly away from a center of the exhaust component such that the member is positioned in the external atmosphere and facing the hole with the open cavity being formed between an inner facing surface of the member and the external surface of the exhaust component.

9. The vehicle exhaust system according to claim 1 wherein the exhaust component comprises a pipe extending from a first pipe end to a second pipe end, and wherein the at least one hole comprises the only hole in the pipe that extends entirely through the wall to external atmosphere.

10. The vehicle exhaust system according to claim 9 wherein the pipe is defined by a pipe length and wherein the hole is positioned at a location that is approximately 50% of the pipe length.

11. The vehicle exhaust system according to claim 1 wherein the exhaust component comprises a pipe extending from a first pipe end to a second pipe end, and wherein the at least one hole comprises only a first hole and a second hole, the first and second holes extending entirely through the wall to the external atmosphere, and with each hole being covered by one member formed of the resistive material.

12. The vehicle exhaust system according to claim 11 wherein the pipe is defined by a pipe length and wherein the first hole is positioned at a location that is approximately 50% of the pipe length and the second hole is positioned at location that is approximately 75% of the pipe length.

13. The vehicle exhaust system according to claim 1 including an outer retainer to secure the member against the spacer.

14. The vehicle exhaust system according to claim 13 wherein the member is defined by outer edges, and wherein the outer edges are sandwiched between the spacer and the outer retainer.

15. The vehicle exhaust system according to claim 13 wherein the outer retainer, the member, and the spacer are welded to the exhaust component.

16. The vehicle exhaust system according to claim 1 wherein the member is defined by an area and wherein the resistive material has a predetermined porosity, and wherein a circumference of the hole multiplied by a thickness dimension of the open cavity is greater than or equal to the area of the member multiplied by the predetermined porosity.

17. The vehicle exhaust system according to claim 1 wherein the actuator is passively controlled to vary damping.

18. The vehicle exhaust system according to claim 1 wherein the actuator is actively controlled to vary damping.

19. The vehicle exhaust system according to claim 1 wherein the operating characteristic comprises at least one or more of a back pressure characteristic, a mass flow characteristic, a temperature characteristic, an engine speed characteristic, an acoustic pressure characteristic, and a user driving condition.

20. A vehicle exhaust system comprising:

an exhaust component having an outer surface comprising an external surface and an inner surface that defines an internal exhaust component cavity;

at least one hole open to external atmosphere and formed in the exhaust component to extend through a wall of the exhaust component from the external surface to the inner surface;

a resonance damper associated with the at least one hole; and an actuator with a covering element located externally of the exhaust component that is configured to cover and uncover the resonance damper to vary damping dependent upon an operating characteristic.

21. The vehicle exhaust system according to claim 20 wherein the actuator is passively controlled to vary damping.

22. The vehicle exhaust system according to claim 20 wherein the actuator is actively controlled to vary damping.

23. The vehicle exhaust system according to claim 20 wherein the operating characteristic comprises at least one or more of a back pressure characteristic, a mass flow characteristic, a temperature characteristic, an engine speed characteristic, an acoustic pressure characteristic, and a user driving condition.

24. The vehicle exhaust system according to claim 20 wherein the at least one hole is directly open to the external atmosphere and comprises at least one bleed hole formed in the exhaust component to reduce a resonance frequency, the at least one bleed hole comprising a discontinuous opening from the external atmosphere into the internal exhaust component cavity.

25. The vehicle exhaust system according to claim 24 wherein the discontinuous opening into the exhaust path is provided by a porous member that is associated with the at least one bleed hole.

26. The vehicle exhaust system according to claim 25 wherein the exhaust component is defined by an overall length extending between a first end and a second end, and wherein the at least one bleed hole is located at an anti-node position that is approximately 25% of the overall length from either the first or second pipe end.

27. The vehicle exhaust system according to claim 25 wherein the exhaust component is defined by an overall length extending between a first end and a second end, and wherein the at least one bleed hole is located at an anti-node position that is approximately 50% of the overall length from either the first or second pipe end.

28. The vehicle exhaust system according to claim 20 including a member formed from a resistive material and configured to overlap the at least one hole, and at least one spacer configured to space the member away from the inner or external surface of the exhaust component to create an open cavity between the member and the exhaust component.

* * * * *